United States Patent [19]

Koizumi et al.

[11] Patent Number: 4,733,036

[45] Date of Patent: Mar. 22, 1988

[54] COIL SPRING FOR KEY SWITCH

[75] Inventors: Haruyuki Koizumi; Koichi Omae, both of Kyoto, Japan

[73] Assignee: Omron Tateisi Electronics Co., Kyoto, Japan

[21] Appl. No.: 931,980

[22] Filed: Nov. 24, 1986

Related U.S. Application Data

[63] Continuation of Ser. No. 724,296, Apr. 17, 1985, abandoned.

[30] Foreign Application Priority Data

Apr. 19, 1984 [JP] Japan ..... 59-57982[U]
Apr. 19, 1984 [JP] Japan ..... 59-79863
Apr. 19, 1984 [JP] Japan ..... 59-79864
Apr. 19, 1984 [JP] Japan ..... 59-148584

[51] Int. Cl.[4] ..... H01H 3/12

[52] U.S. Cl. ..... 200/340; 200/159 B; 200/276

[58] Field of Search ..... 200/159 B, 340, 276, 200/5 A

[56] References Cited

U.S. PATENT DOCUMENTS 3,721,784 3/1973 Viracola ..... 200/276
4,468,542 8/1984 Pounds ..... 200/340
4,529,848 7/1985 Cherry ..... 200/340

FOREIGN PATENT DOCUMENTS 2046996 11/1980 United Kingdom ..... 340/

*Primary Examiner*—Henry J. Recla
*Assistant Examiner*—Renee S. Luebke
*Attorney, Agent, or Firm*—Stevens, Davis, Miller & Mosher

[57] ABSTRACT

A key switch is disclosed which employs a coil spring formed of a spring element and which has a smaller-diameter portion, a conical portion joined to one end of the smaller-diameter portion, and a larger-diameter portion joined to the other end of the smaller-diameter portion. The smaller-diameter portion has the spring element coiled at a relatively small diameter. The conical portion has the spring element extending coiled so as to increase its diameter progressively toward an open end thereof. The larger-diameter portion has a diameter larger than the diameter of the smaller-diameter portion. The conical portion is maintained under compression and the small-diameter portion is maintained in proximity to a contact area by elements of the key switch to provide a linearly increasing depression force for the key switch.

4 Claims, 10 Drawing Figures

COIL SPRING FOR KEY SWITCH

This application is a continuation of application Ser. No. 724,296, filed Apr. 17, 1985, now abandoned.

BACKGROUND OFF THE INVENTION

The present invention relates to a key switch for use in the keyboard of an electronic cash register, a personal computer, or the like, and more particularly to a coil spring incorporated in such a key switch.

As shown in FIG. 1 of the accompanying drawings, a conventional key switch of the type described is composed of a guide cylinder 9 fixed to a key attachment plate 90, a key plunger 91 reciprocally movably disposed in the guide cylinder 9, a spring seat 93 of silicone rubber fitted in the lower opening of the guide cylinder 9, a first coil spring 94 disposed on the spring seat 93 in the guide cylinder 9 for returning the key plunger 91 upwardly, a second coil spring 95 for pushing downwardly a central switch actuator 92 on the spring seat 93, and a key top 96 mounted on the upper end of the key plunger 91. Since the illustrated prior key switch requires two coil springs, it has been necessary to individually stack separate coil springs.

For assembling the key switch on the key attachment plate 90, the key plunger 91 and the coil springs 94, 95 are first inserted into the guide cylinder 9 through its lower opening, then the spring seat 93 is fitted in the lower opening of the guide cylinder 9, and finally the key top 96 is fitted over the upper end of the key plunger 91 which projects upwardly from the guide cylinder 9. Since it is necessry to assemble the key switch on both sides of the key attachment plate 90, assembly efficiency is low, and it is difficult to increase the number of switches or change the arrangement of switches. With the illustrated key switch, furthermore, there are required a total of six parts, including the guide cylinder 9, the key plunger 91, the spring seat 93, the two coil springs 94, 95, and the key top 96. During assembly, therefore, the parts are required to be positioned for the attachment of each coil spring, resulting in various practical problems such as a complex assembling process, a low assembling efficiency, and a complicated stock of parts.

SUMMARY OF THE INVENTION

A coil spring for use in a key switch according to the present invention comprises a smaller-diameter portion having a spring element coiled at a relatively small diameter, a conical portion having a spring element extending continuously from one end of the spring element of the smaller-diameter portion and coiled so as to increase its diameter progressively toward an open end thereof, and a larger-diameter portion having a spring element extending continuously from an opposite end of the spring element of the smaller-diameter portion and having a diameter larger than the diameter of the smaller-diameter portion.

In a preferred embodiment, the larger-diameter portion is in the form of a cylinder with its spring element coiled at equal pitches and an equal diameter.

In another embodiment, the larger-diameter portion is in the form of a cone with its spring element having a diameter which is progressively larger towards its open end.

In still another embodiment, the coil spring further includes a flat portion interposed continuously between the smaller-diameter portion and the conical portion, the flat portion having a spring element with its diameter progressively greater in one plane.

Accordingly, it is a major object of the present invention to provide a novel coil spring for use in a key switch, which can reduce the number of parts of the key switch and which allows the key switch to be assembled simply and efficiently.

Another object of the present invention is to provide a coil spring for use in a key switch, which enables switch contacts to be accurately pressed, and which can expand and contract well without buckling under a key depressing force.

Still another object of the present invention is to provide a novel key switch which has a spring seat integral with a guide cylinder and a single coil spring, is made up of a reduced number of parts, and can be assembled simply and efficiently.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
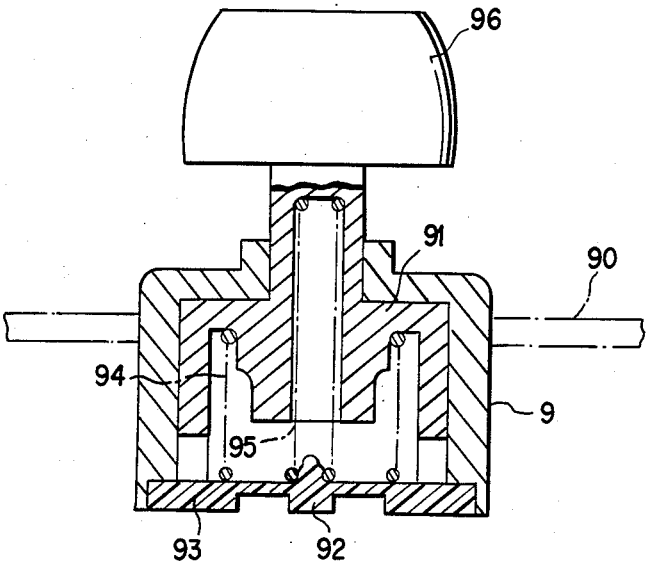
FIG. 1 PRIOR ART
FIG. 1 is a cross-sectional view of a conventional key switch.
Figure 2:
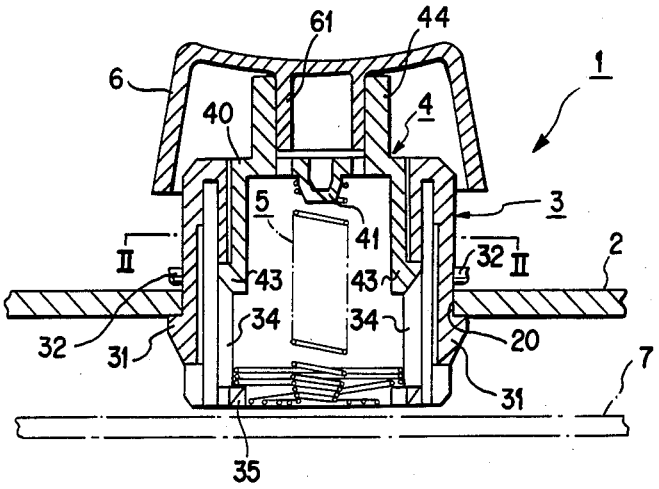
FIG. 2 is a longitudinal cross-sectional view of a key switch incorporating a coil spring of the present invention.
Figure 3:
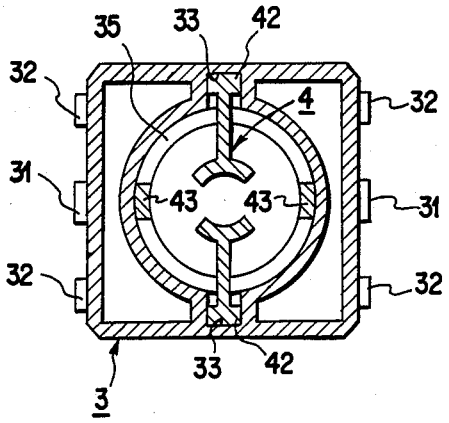
FIG. 3 is a cross-sectional view taken along line II—II of FIG. 2.
Figure 8A:
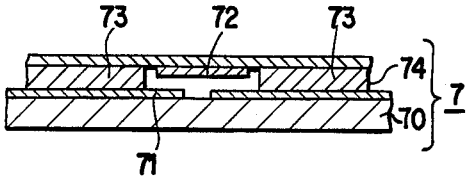
FIGS. 8A and 8B are cross-sectional views of a switch plate, showing switching operation.
Figure 8B:
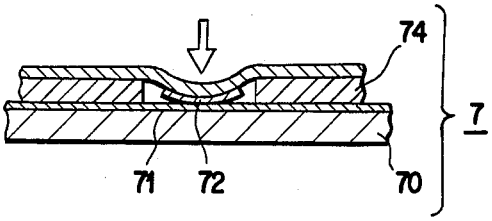

FIGS. 2 and 3 illustrate a key switch in which a coil spring according to the present invention is incorporated. The key switch, generally designated at 1, has a guide cylinder 3 fixed to a key attachment plate 2, a key plunger 4 reciprocally movably disposed in the bore in the guide cylinder 3, a coil spring 5 disposed in the cylinder bore and interposed between the guide cylinder 3 and the key plunger 4, and a key top 6 mounted on the upper end of the key plunger 4. A switch plate 7 is disposed below the key switch 1 parallel to the key attachment plate 2. When the key top is depressed, the coil spring 5 projects downwardly from the guide cylinder 3 to press the switch plate 7 (see FIG. 4). As shown in FIG. 8A, the switch plate 7 comprises a baseboard 70 on which a circuit pattern having a fixed contact 71 is printed, and a flexible sheet 74 having a printed movable contact 72 with a spacer 73 attached in surrounding relation to the movable contact 72. The flexible sheet 74 is disposed on the baseboard 70 so that the movable contact 72 is positioned over the fixed contact 71. When the coil spring 5 presses the flexible sheet 74, the movable contact 72 is brought into contact with the fixed contact 71 to close the switch as shown in FIG. 8B.

The guide cylinder 3 has on its outer peripheral surface retaining pawls 31 and locking fingers 32 in vertically spaced relation. The guide cylinder 3 can be attached to the key attachment plate 2 by fitting the guide cylinder 3 into an attachment hole 20 in the key attachment plate 2 and positioning the edge of the attachment hole 20 between the retaining pawls 31 and the locking fingers 32. The guide cylinder 3 has diametrically opposite guide grooves 33 and recesses 34 defined in the inner peripheral surface of the cylinder bore, the recesses 34 being angularly positioned in right-angularly spaced relation to the grooves 33. A spring seat 35 is disposed in the lower opening of the cylinder bore and extends fully around the cylinder bore, the spring seat 35 being formed by bending the edge of the cylinder bore radially inwardly.

The key plunger 4 has a slide plate 40 having a diameter corresponding to that of the bore in the guide cylinder 3. The side plate 40 has a central support 41 projecting downwardly for supporting the coil spring 5. The slide plate 40 also has guide members 42 extending downwardly from its peripheral edges and slidably fitted in the guide grooves 33, respectively, and stop members 43 extending downwardly from its peripheral edges and engaging in the recesses 34, respectively. A cylindrical wall 44 projects upwardly from the upper surface of the slide plate 40. A boss 61 projecting downwardly from the inner surface of the key top 6 is fitted in the cylindrical wall 44.

Figure 5:
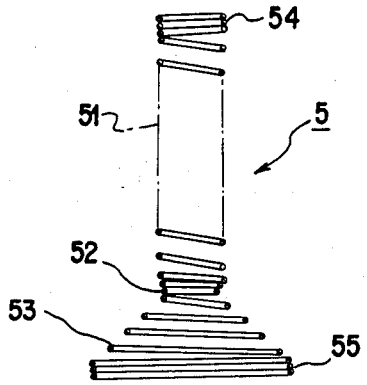
FIG. 5 is a front elevational view of a coil spring forming a first embodiment of the invention.

FIG. 5 shows a preferred embodiment of the coil spring 5 in its entirety. The illustrated coil spring 5 is composed of a cylindrical portion 51 coiled at equal pitches and an equal diameter, a smaller-diameter necked portion 52 having a smaller pitch and diameter than the cylindrical portion 51, and a coinical portion 53 having its diameter progressively larger than that of the smaller-diameter portion 52, the portions 51, 52, 53 being continuously helically coiled.

The conical portion 53 is positioned on the spring seat 35 of the guide cylinder 3 for normally urging the key plunger 4 to move upwardly so that when the key is depressed, the key plunger 4 will return upwardly to a standby position. The smaller-diameter portion 52 serves to project downwardly from the lower opening of the guide cylinder 3 into contact with the switch plate 7 when the key is depressed. The cylindrical portion 51 serves to urge the smaller-diameter portion 52 to be pressed against the switch plate 7. Therefore, by reducing the diameter of the smaller-diameter portion 52, the pressing force is concentrated on the smaller-diameter portion 52 to press the contacts of the switch plate 7 into good contact with each other. The smaller-diameter portion 52 allows the cylindrical portion 51 to be increased suitably in diameter, thus preventing the cylindrical portion 51 from buckling under pressing forces.

With the coil spring 5 shown in FIG. 5, the ratio of the diameters of the spring portions is such that if the diameter of the cylindrical portion 51 is 1, then the diameter of the smaller-diameter portion 52 has a proportion of about 0.8, and the maximum diameter of the conical portion 53 has a proportion of about 3.5. The cylindrical portion 51 and the conical portion 53 have on their ends reinforced portions 54, 55 each composed of about three spring coils or convolutions wound closely to each other. The reinforced portion 54 is supported by the slide plate 40 of the key plunger 4, while the reinforced portion 55 is supported by the spring seat 35 of the guide cylinder 3.

Figure 6:
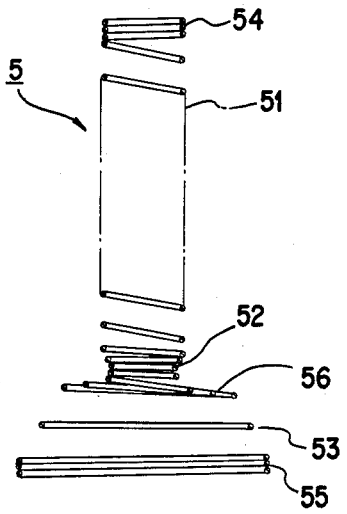
FIG. 6 is a front elevational view of a coil spring forming a second embodiment of the invention.

FIG. 6 shows another embodiment of the coil spring 5 of the present invention in its entirety. The illustrated coil spring 5 is composed of a cylindrical portion 51 coiled at equal pitches and an equal diameter, a smaller-diameter necked portion 52 having smaller pitches and diameter than the cylindrical portion 51, a flat portion 56 having a diameter progressively larger than that of the smaller-diameter portion 51 and coiled in one plane, and a conical portion 53 having its diameter progressively larger than that of the flat portion 56, the portions 51, 52, 56, 53 being continuously helically coiled. The cylindrical portion 51, the smaller-diameter portion 52, and the conical portion 53 have the same functions as described above with reference to FIG. 5. The embodiment of FIG. 6 resides in that the flat portion 56 is disposed between the smaller-diameter portion 52 and the conical portion 53. Before the key is operated, the flat portion 56 supports the smaller-diameter portion 52 in the lower opening of the guide cylinder 3. When the key depressing force is applied, the flat portion 56 causes the smaller-diameter portion 52 to project from the lower opening of the guide cylinder 3 prior to the conical portion 53.

Figure 7:
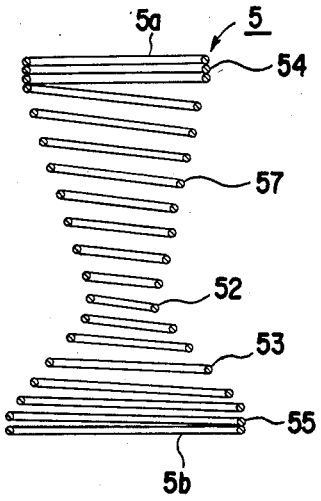
FIG. 7 is a front elevational view of a coil spring forming a third embodiment of the invention.

FIG. 7 shows still another embodiment of the coil spring 5 of the present invention in its entirety. The illustrated coil spring 5 is composed of a necked smaller-diameter portion 52 with a substantially central portion being of a reduced diameter, and conical portions 52, 57 having pitches and diameters progressively larger in the directions away from the smaller-diameter portion 52 toward the opposite ends 5*a*, 5*b*. The coil spring 5 comprises a single spring wire formed as continuous coils extending from the end 5*a* to the other end 5*b*. The smaller-diameter portion 52 and the conical portion 53 function in the same manner as described above with reference to FIG. 5. According to the embodiment of FIG. 7, the cylindrical portion 51 of FIG. 5 is replaced with the conical portion 57. The diameter proportions of this embodiment are such that if the diameter of the smaller-diameter portion 52 is 1, then the ends 5*a*, 5*b* of the conical portions 53, 57 are about 3.5.

The key switch 1 constructed as shown in FIGS. 2 and 3 can be assembled as follows: After the guide cylinder 3 has been fitted and fixed in the attachment hole 20 in the key attachment plate 2, the coil spring 5 is inserted into the bore in the guide cylinder 3 from its upper opening, and the conical portion 53 is positioned on the spring seat 35. Then, the key plunger 4 with the key top 6 mounted is inserted into the cylinder bore to cause the stop members 43 to engage in the recesses 34, respectively. The key switch 1 is thus completely assembled. Under this condition, the conical portion 53 of the coil spring 5 is compressed with the smaller-diameter portion 52 positioned in the lower opening in the guide cylinder 3 (see FIG. 2).

Figure 4:
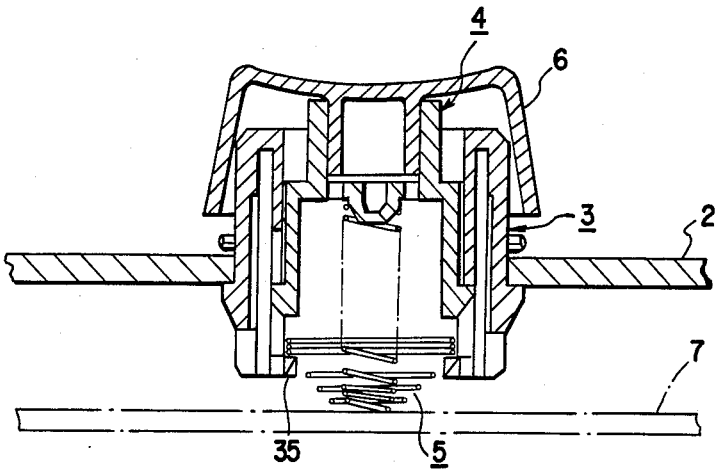
FIG. 4 is a longitudinal cross-sectional view of the key switch as it is depressed.

When the key top 6 is depressed, the key plunger 4 is lowered to further compress the conical portion 53, and the smaller-diameter portion 52 projects downwardly from the lower opening in the guide cylinder 3 into contact with the switch plate 7 (see FIG. 4). When the key plunger 4 reaches the lowermost limit, the cylindrical portion 51 urges the smaller-diameter portion 52 to be pressed against the switch plate 7. The switch contacts are now held in contact with each other between the baseboard 70 and the flexible sheet 74 (see FIG. 8B).

Figure 9:
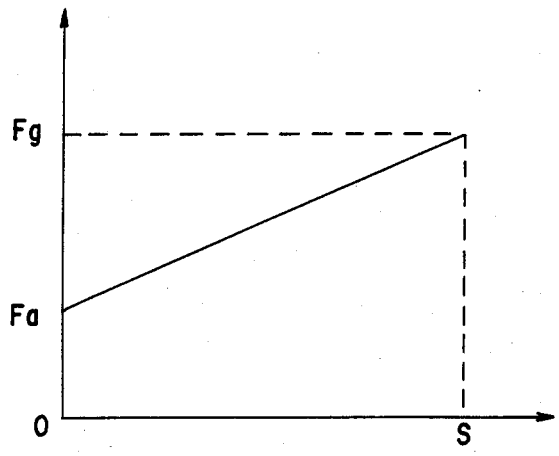
FIG. 9 is a diagram explanatory of the depressing characteristics of the key switch.

FIG. 9 shows the key pressing force on the coil spring 5 is plotted against the stroke of the key plunger 4. Fa indicates a pressing force on the coil spring 5 under an initial condition. The switch contacts are held against each other by increasing the pressing force from Fa to Fg to move the key plunger 4 a stroke S in the cylinder bore.

If the coil spring 5 with its cylindrical portion 52 shorter in length is inserted in the guide cylinder 3, the switch contacts are not brought into contact with each other even when the key plunger 4 is depressed. Such a modified coil spring is therefore effective in providing a dummy key switch.

Although certain preferred embodiments have been shown and described, it should be understood that many changes and modifications may be made therein without departing from the scope of the invention, which is defined in the appended claims.

What is claimed is:

1. A key switch comprising:

a guide member having a spring seat in a lower portion of a bore defined in said guide member, said lower portion of said guide member including an opening communicating with said bore;

a key plunger mounted within said bore for reciprocal movement;

a key top mounted on an upper end of said key plunger;

a pair of electrical contacts;

a coil spring formed of a continuous spring element interposed between said guide member and said key plunger, said coil spring comprising:

a smaller-diameter portion at which the spring element is coiled at a relatively small diameter;

a conical portion, extending continuously from one end of said smaller-diameter portion, at which the spring element is coiled so that its diameter progressively increases toward an open end of said conical portion, said conical portion having said open end positioned on said spring seat in said bore; and a larger-diameter portion, extending continuously from another end of said smaller-diameter portion, at which the spring element has a diameter larger than the diameter of said spring element at said smaller-diameter portion, said coil spring, when said key switch is unactuated, being maintained by said key plunger and spring seat in a state wherein said conical portion is compressed and said smaller diameter portion is positioned in the lower portion opening of said guide member, said key plunger when depressed, compressing said coil spring to cause said smaller diameter portion to protrude from said lower portion opening of said guide member; and, means responsive to said protrusion of said smaller diameter portion of said coil spring upon depression of said key plunger for actuating said electrical contacts.

2. A key switch according to claim 1, wherein said larger-diameter portion is in the form of a cylinder with said spring element being coiled at equal pitches and with an equal diameter throughout said large-diameter portion.

3. A key switch according to claim 1, wherein said larger-diameter portion is in the form of a cone with said spring element having a diameter which is progressively larger toward an open end of said cone.

4. A key switch according to claim 1, wherein said coil spring further includes a flat portion interposed between said smaller-diameter portion and said conical portion, said spring element having a diameter at said flat portion which is progressively greater in one plane.

* * * * *